US005538361A

United States Patent [19]

Beamer

[11] Patent Number: 5,538,361

[45] Date of Patent: Jul. 23, 1996

[54] APPARATUS FOR FORMING A TRENCH

[75] Inventor: John V. Beamer, Atlanta, Ga.

[73] Assignee: Hoosier Group, L.L.C., Atlanta, Ga.

[21] Appl. No.: 279,634

[22] Filed: Jul. 22, 1994

[51] Int. Cl.[6] ..... E02B 5/00

[52] U.S. Cl. ..... 405/118; 405/119; 249/11; 249/177; 404/2; 404/4

[58] Field of Search ..... 405/118–121, 126; 249/1–9, 11, 63, 65, 177, 83, 195; 404/2, 4

[56] References Cited

U.S. PATENT DOCUMENTS

| | | | |
|---|---|---|---|
| 988,049 | 3/1911 | Tingley | 249/11 X |
| 1,008,264 | 11/1911 | Hill | 249/177 |
| 1,700,889 | 2/1929 | Heltzel . | |
| 1,722,038 | 7/1929 | Dougherty | 249/177 X |
| 2,896,301 | 7/1959 | Barron | 249/177 |
| 2,917,804 | 12/1959 | Barron | 249/177 X |
| 4,085,918 | 4/1978 | Wilkerson | 249/177 X |
| 4,258,897 | 3/1981 | Stees | 249/11 |
| 4,993,877 | 2/1991 | Beamer . | |
| 4,993,878 | 2/1991 | Beamer . | |
| 5,000,621 | 3/1991 | Beamer . | |
| 5,256,000 | 10/1993 | Beamer . | |
| 5,281,052 | 1/1994 | Beamer . | |
| 5,326,189 | 7/1994 | Beamer . | |
| 5,326,190 | 7/1994 | Beamer . | |

*Primary Examiner*—Dennis L. Taylor
*Attorney, Agent, or Firm*—Needle & Rosenberg

[57] ABSTRACT

A system for forming a single-walled trench comprising a pair of frame members, each having a horizontal section and a section depending from the horizontal section; a collapsing pair of wall pans having sidewalls interior to the depending portion of the frame members, a bottom floor disposed between the sidewalls, a releasing mechanism to collapse inward the sidewalls, a device which collapses the sidewalls inward and removes the entire bottom and sidewalls from the poured trench leaving the frames embedded securely in the concrete; and adjustable anchoring means attached to the frame members for providing vertical adjustment of the frame members relative to the ground and each other, leaving all but the frame members available for re-use.

5 Claims, 7 Drawing Sheets

APPARATUS FOR FORMING A TRENCH

BACKGROUND OF THE INVENTION

1. Field of the invention

The present invention relates to the construction industry, and more specifically to the formation of a pre-engineered grate or covered trench including a removable assembly for forming a trench with parallel and level frames left embedded in the concrete, ready to accept grates or covers.

2. The Prior Art

The general concept of trench drainage has long been used. Trenches are used where liquid run-offs occur, such as chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it. It is made in some applications as solidly covered. Such applications include crossing sidewalks and where conduits are carried within the trench and fluid entry is minimal and not necessarily desirable.

In the prior art, a removable inner wall subsequent to pouring concrete or other hardening material has been used for many years. These inner walls have normally been put in place by labor intensive means such as the use of plywood sidewalls placed in a trench with a pre-poured bottom and crossed braced to withstand the hydrostatic pressure of the material forming the walls of the trench. Removal of these forms is time consuming and in most cases the components are not reusable. In the prior art, sloping the trench was difficult; mounting the frames to be parallel and level is extremely difficult, creating a smooth flowing surface is virtually impossible, all of which makes the method very costly.

There exists a need for a reusable trench forming device that can be used to make trenches of many trench depths and widths.

There also exists a need for a removable trench forming system onto which frames can be easily attached, providing for virtually any required slope.

There also exists a need for a removable trench forming system which can be quickly removed without damaging the forms.

There also exists a need for a removable trench forming system that can be self supporting in the trench at the time of pouring material around the form.

There also exists a need for a removable trench forming system that can be supported from adjacent formed slabs at the time of pouring material around the form.

There also exists a need for a removable trench forming system for making very wide trenches.

SUMMARY OF THE INVENTION

The disadvantages of the prior art are overcome by the present invention which applies to a grate or solid covered trench.

The present invention is a reusable trench form that can form a trench with virtually any predetermined drain slope. It does not require the cutting and placing of plywood inner walls and it provides a smooth drain surface in the drain area of the trench. It provides a trench form which accepts a single or multiple pouring of the trench-wall forming material to form the trench walls. The trench-wall forming material is usually concrete, but it can be any material that can be poured around a mold and harden (for example: resin, metal, etc.), depending upon the application involved.

A pair of adjustable frames for maintaining a grate or solid cover in a stable position along the trench are provided. The frame design is essentially the same as in U.S. Pat. Nos. 5,000,621 and 4,993,878 except that the slots in the frame may be substituted with partial slots, round, square or other shaped holes, while the sidewalls may have either slots, partial slots, round, square or other shaped holes, depending upon the amount of slope that is required in the trench.

Each of the frames include adjustable anchoring means for vertically adjusting the trench relative to the ground. The trench system may be moved up or down to the finished surface elevation prior to the pouring of concrete or other surrounding material. The anchoring means include a tubular collar which has an opening through which a supporting rod may pass. It is preferred that the anchoring means appear at each opposite end of the above described frames, although addition of such anchoring means may be provided in between the ends of relatively long frames for additional support. Each collar has a threaded bore through which a correspondingly threaded bolt may be placed for securing the collar and hence the frames and trench system in position along the rod. Multiple bores and corresponding bolts may also be placed in each collar to enhance securing the position of the collar along the rod. The top of the rod should be at least one inch below the top surface of the trench, otherwise the concrete at the surface of the trench might crack prematurely.

The trench containment unit comprises a holding pan or trench wall containing means which is encased by concrete or other materials.

The sidewalls will be attached securely to the frames and generally consist of material such as steel, fiberglass, plastic or wood which will be encased in concrete or other material.

The collapsing sidewalls will be attached to the frames with bolts and possibly washers and secured with wing nuts which will later be left in the concrete or other material forming the trench wall. Toward each end of the collapsible sidewall will be found a series of slots, round holes, or other shaped holes vertically arranged in straight or in a staggered manner to be used as attachment means for the frames, using fasteners such as nuts and bolts. The spacing of these holes or slots provides a means by which virtually any trench slope may be established at any depth on the collapsible trench wall. By this means one set of collapsible trench walls with the vertical frame holding system allows identical sets of collapsible walls with attached frames to produce a very long sloped trench. By producing wider and deeper collapsible walls an infinite variety of trench widths, depths and slopes are possible with the collapsible walls reusable many times.

The prior art does not disclose a simple reusable, collapsible trench wall with an easily attached frame with virtually any slope, nor does it disclose a trench form with collapsible sidewalls which can be easily removed from and attached to frames, leaving the frames level, parallel and ready to accept grates or solid covers.

It is, therefore, an object of the present invention to provide for a less expensive means to produce a trench with frames.

It is also an object of the present invention to build a collapsible and reusable system to form a trench.

It is also an object of the present invention to provide a form wherein a number of uniform collapsible sidewalls can produce a variety of trench slopes.

It is also an object of the present invention to provide a form wherein a number of uniform collapsible sidewalls can produce a variety of trench depths.

It is also an object of the present invention to provide a form wherein a number of uniform collapsible sidewalls can produce a long trench.

It is also an object of the present invention to provide a form wherein a collapsible sidewall system can produce very wide trenches.

It is also an object of the present invention to provide a form wherein a collapsible sidewall system can produce a very deep trench.

These and other objects will become apparent from the following description of the preferred embodiments taken in conjunction with the following drawings, although variations and modifications may be effected without departing from the spirit and scope of the novel concepts of the disclosure.

DETAILED DESCRIPTION OF THE PREFERRED EMBODIMENTS

Figure 1:
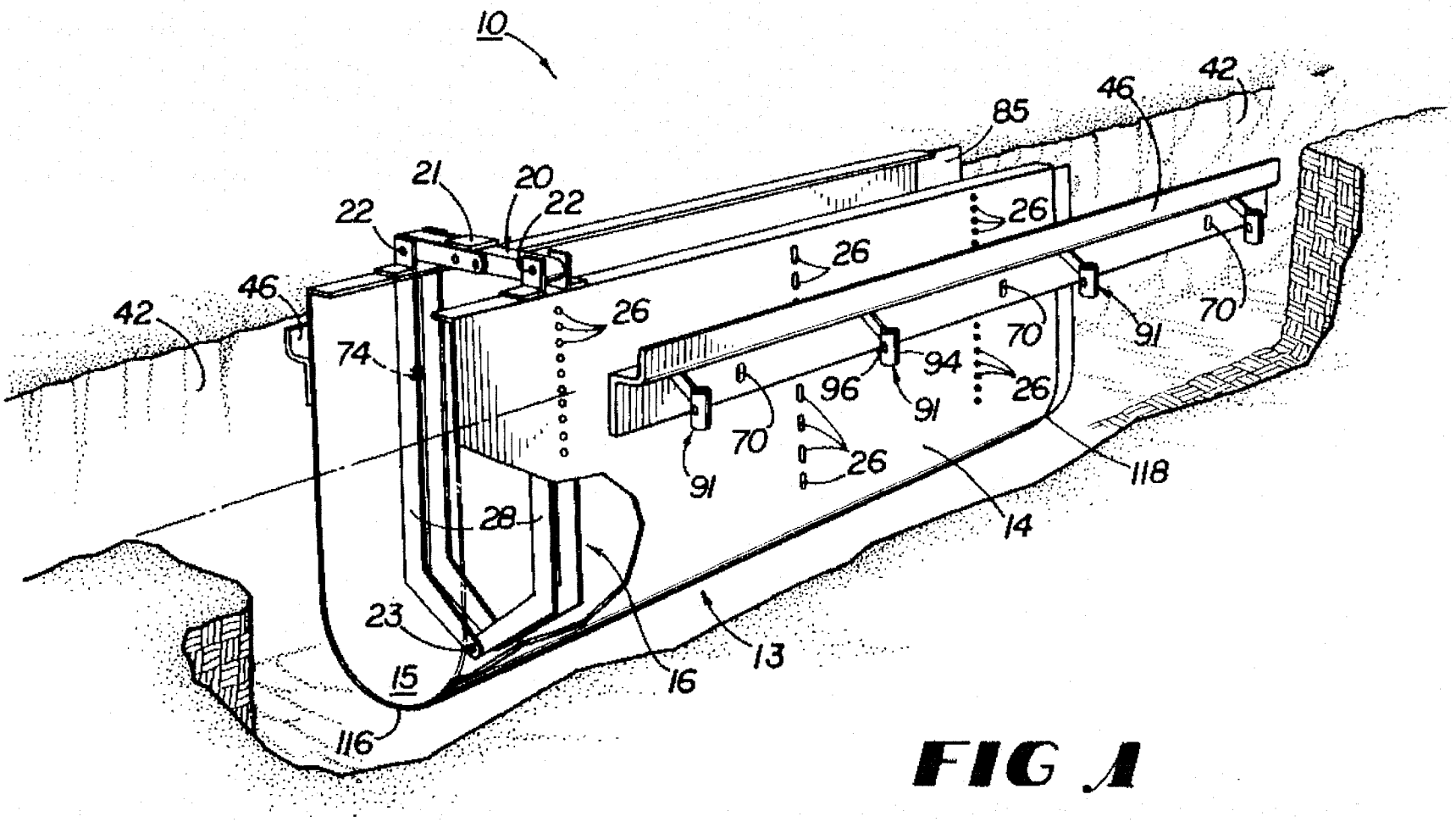
FIG. 1 is an exploded perspective view of a collapsible wall assembly for normal sized trenches.

FIG. 1 is a perspective view of a trench assembly of the present invention 10. The removable and reusable trench forming apparatus being shown comprises a reusable form pan 13, which further comprises two upstanding sidewalls 14, each having upper and opposed lower surfaces and flexible base or bottom 15 attached to, and interconnecting, the lower surfaces of the sidewalls 14. Two frame members 46 are attached external to the form pan 13, one on each side. At least one end of the form pan 13 may have a means 85 for interconnecting the form pan to other form pans (not shown) to enable the construction of trenches of varying lengths and varying paths. Also shown is an adjustable anchoring means 91 for anchoring the form pan 13 to the ground prior to placing concrete or other trench-forming materials around the form pan 13.

Figure 2:
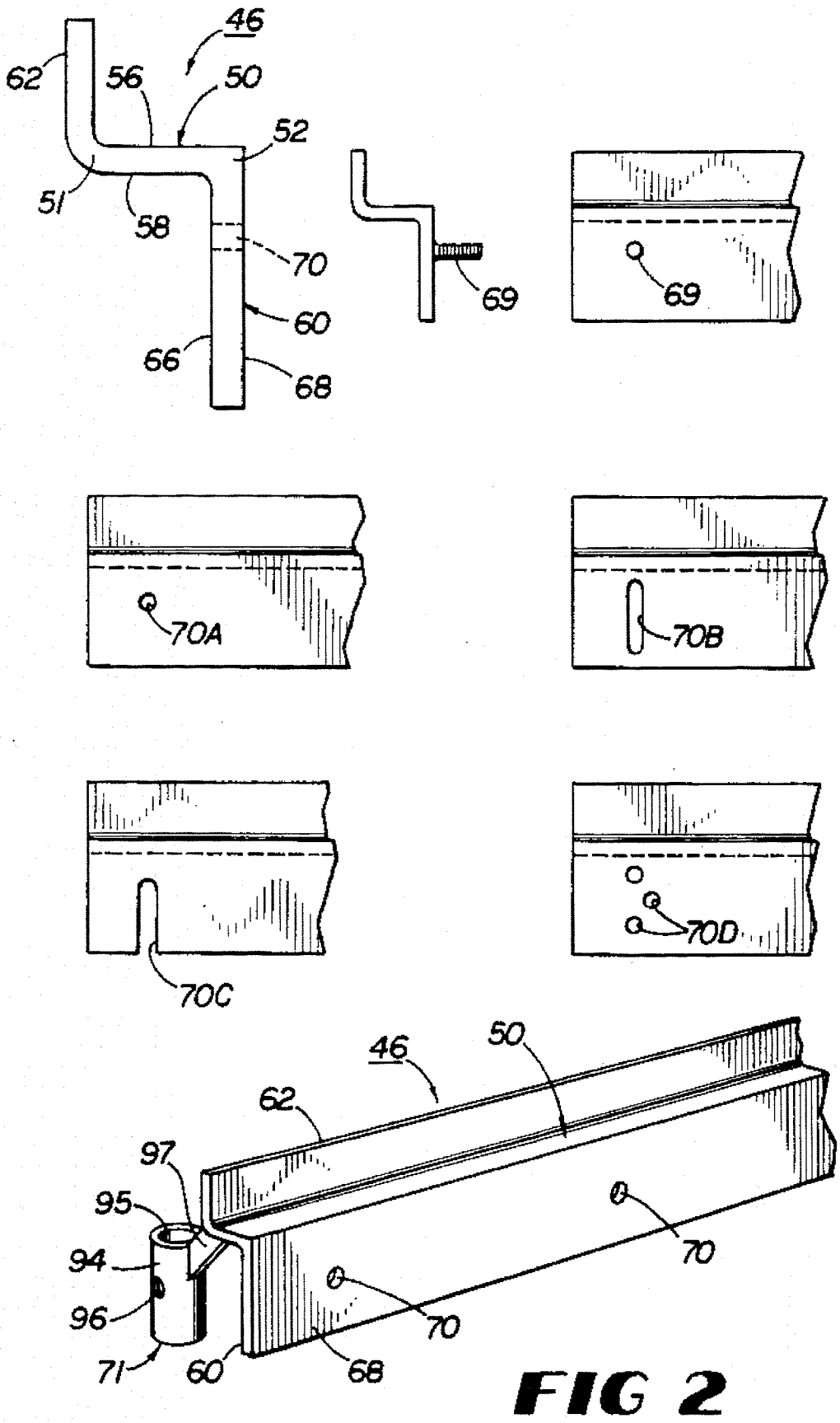
FIG. 2 is a cross-section view of a "Z" shaped frame with various wall attaching means.

Referring to FIG. 2, the frame members 46 typically have a "Z" shape in cross-section, with a central horizontal section 50, a depending portion 60 with a vertical surface 68, joined to the forward edge 52 of the horizontal section 50, and a grate contacting member 62, ascending from the rearward edge 54 of the horizontal section 50.

Referring to FIG. 2, into the depending section 60 there will be at least one hole or opening 70 which may be round 70*a*, oblong 70*b*, partial slotted 70*c*, staggered 70*d*, or square (or any other practicable shape). Hole 70 will be formed through the depending section 60 to accept a bolt passing through each of the two upstanding sidewalls 14 and the frame member 46. The bolt 74 will be fastened, preferably by a wing nut or any other shaped nut that may remain in the sidewall.

A means for adjustably and removably securing each frame member 46 to each of the two upstanding sidewalls 14 comprises a plurality of holes or openings 26 in each of the two upstanding sidewalls 14 which are of such a size as to accept a bolt 74, or other fastening means, used on frame 46. A permanent bolt 69 may also be affixed to the depending part 60 of the frame member 46 in positions to pass through the holes 26 in each of the two upstanding sidewalls 14.

Referring again to FIG. 1, there will be a minimum of two vertical lines of holes or slots 26 on each side of the two upstanding sidewalls 14 positioned to match the holes in the frames. Holes or slots 26 could start at the top of each of the two upstanding sidewalls 14 and go to the point of the most shallow trench to be made for the width of the trench. The large number of holes or slots 26 allows the frames to be attached for various trench depths and for various trench slopes.

In the preferred embodiment, through each of these bolt holes one or more threaded bolts 74 (or an affixed bolt 69 as shown in FIG. 2) will pass, to secure the frame member 46 to each of the two upstanding sidewalls 14 on form pan 13.

Referring again to FIG. 2, the bolt holes of varying shapes, such as those seen at 70*a*, 70*b*, 70*c* and 70*d*, allow the frames to be attached to the wall pans with bolts and nuts in a sloping or level manner, thereby insuring a required slope or neutral trench when the form is removed from concrete or other materials. Bolt 69 attached to the frame is used in a similar manner.

Figure 4:
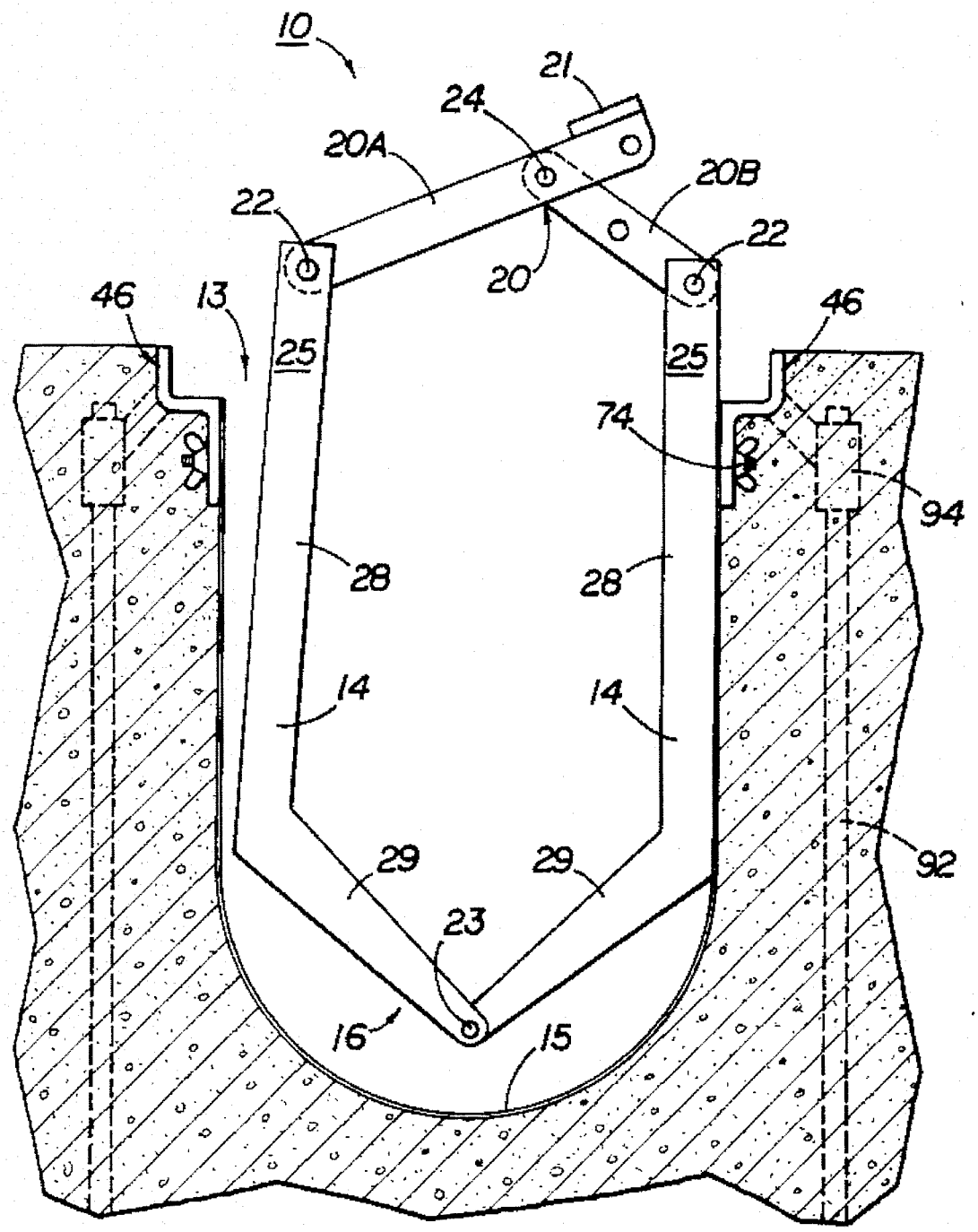
FIG. 4 is a cross-sectional view of a collapsible wall assembly, ready for removal of the walls.

Referring to FIG. 4 the present invention is shown comprising a pair of sidewalls 14 and a flexible base section 15. As shown in FIGS. 1, 4, 5, 6, and 7 the form pan 13 may be made in a "U" shape, in a rectangular shape or any other practicable shape. The form pan 13 may be molded, formed, or extruded from a variety of rigid materials such as stainless steel, mild steel, galvanized or coated steel, aluminum, fiberglass, or a plastic compound.

Figure 3:
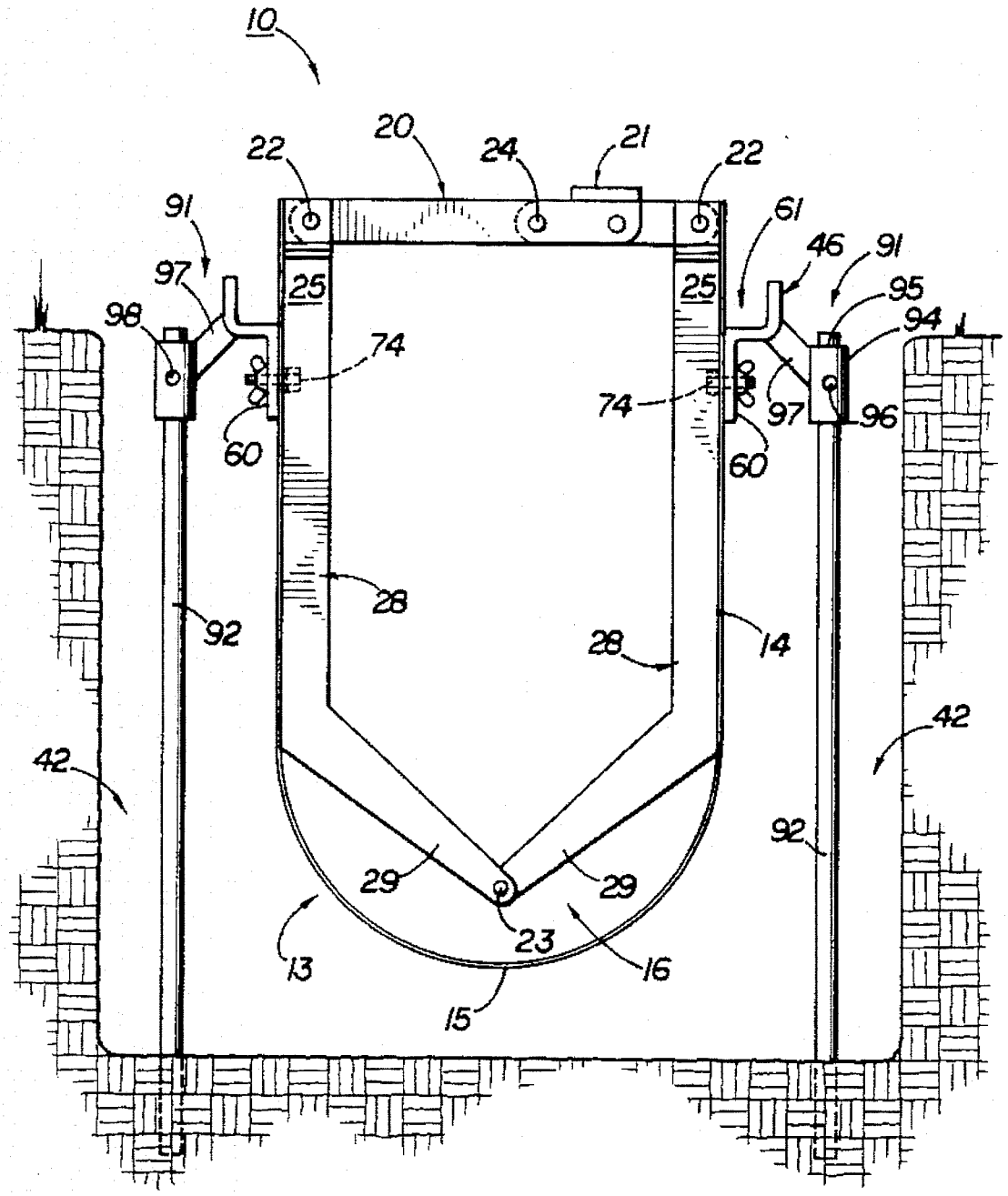
FIG. 3 is a cross-sectional view of a collapsible wall assembly, leveled and ready to pour.

Referring to FIG. 4, the present invention is shown comprising a form pan 13 as shown in FIGS. 1, 3, and 4, comprising a pair of vertical sidewalls 14 connected by a bottom section 15 normally rounded, flat, or sloped downward, which interconnects the sidewalls 14. An internal support means 16, comprising a pair of stiffening members or rigid legs 28 each with a top end 25 and an opposed lower, or bottom, end 29, disposed and secured along the inner surface of the sidewalls 14 in opposed relationship, provides support to the sidewalls 14. The rigid legs 28 are connected at the bottom end 29 at a pivot point 23, which may be a hinge, and the top ends 25 are connected together by locking means 20. A means for moving the support means 16 between an operable position and an inoperable position is provided. In the operable position, the support means 16 support the sidewalls while a trench-forming material is poured around the form pan 13. In the inoperable position, the sidewalls 14 collapse inwards and the form pan 13 can be removed from the trench.

The plurality of locking means 20 are used to maintain separation of the sidewalls 14. The locking means 20 comprise a first rigid element 20A, with a first end and an oppositely disposed second end, and is pivotally mounted about its first end to one of the top ends 25 of one of the rigid legs 28. The second rigid element 20B, also with a first end and an oppositely disposed second end, is pivotally mounted about its first end to the top end 25 of the opposing rigid leg 28. The first rigid element 20A has a first length and the second rigid element 20B has a second length, which may be shorter than the first length. The locking means 20 also comprise: a spacer 21 used to lock the locking means 20 in the fully extended position; a pair of hinges 22 connected to the top ends 25 of the rigid legs 28; and a center hinge 24, which hingedly connects the rigid elements 20A, 20B. They hold the sidewalls. 14 in a rigid, opposite relationship (the operable position), so that the frames 46 attached to the sidewalls will be parallel. The locking means 20 has an secured position (as shown in FIG. 3) and an open position (as shown in FIG. 4).

Referring to FIGS. 3 and 4, the preferred ground anchoring means 41 comprises a supporting rod 92, a cylindrical collar 94, having a threaded bore 96 laterally extending therethrough and a longitudinally extending opening 95 for receiving the supporting rod 92. A bolt 98 which is threaded to match the threaded bore 96 is used to connect the cylindrical collar 94 to the frame 46. A connecting member 97 is attached to the collar 94 connecting it to the frame 46. The rod 92, and the collar 94, and its axial opening 95 need not be cylindrical in shape, any practicable shape will work, depending upon the available materials and the application. FIGS. 3 and 4 show the collar 94, the connecting member 97, and the frame 46 as being integrally formed as a single piece, but other connecting means may be employed, depending upon the application.

Form removal, as shown in FIG. 4, involves several procedures. The first procedure is to remove all bolts 74 used in the form section 10. Left behind in the concrete or other material are nuts, preferably wing nuts, which allow easier removal of the bolts.

Once all bolts are removed a lifting device (not shown) is attached to all spacers 21 of unit 10. By lifting straight upward, hinges 24, 23, and 22 become operative in forcing the form inward and away from the trench walls and bottom at which time the entire unit 10 is brought onto the surface with the frames left embedded in the concrete, level and parallel, ready for grates or solid covers.

Figure 5:
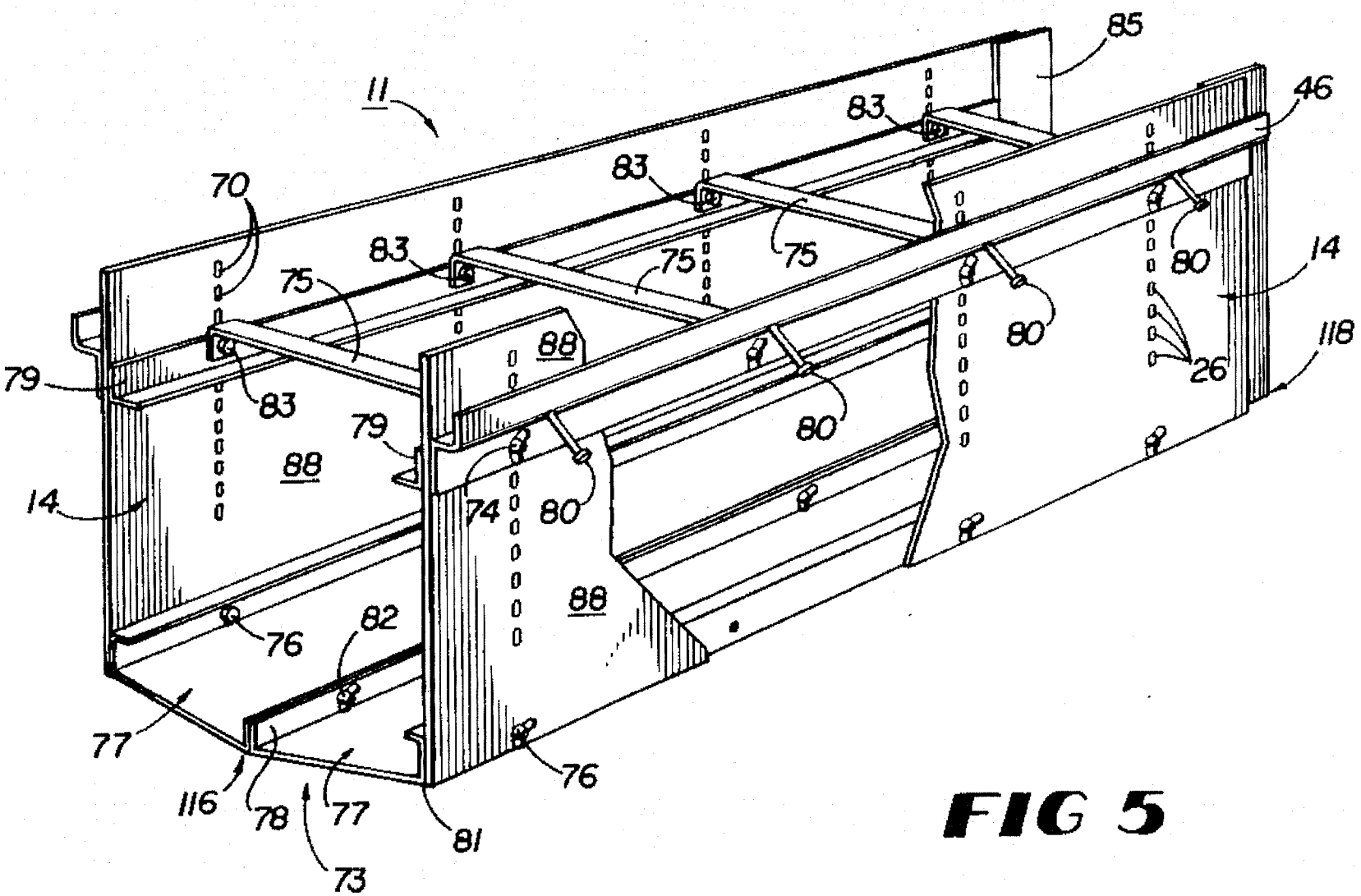
FIG. 5 is a perspective view of a collapsible wall assembly for large or special sized trenches.
Figure 6:
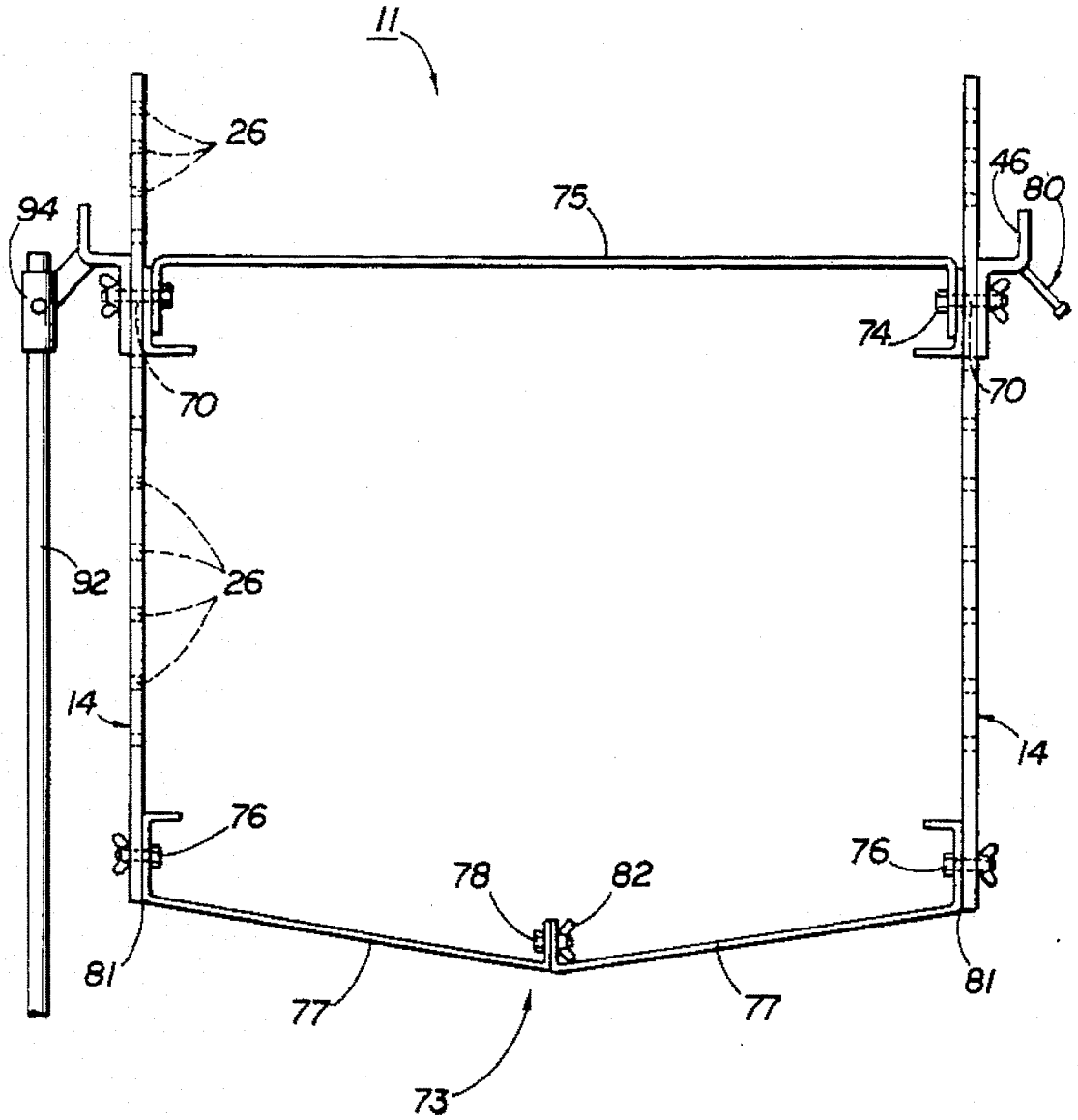
FIG. 6 is a cross-sectional view of a collapsible wall assembly for large or special sized trenches.

Referring to FIGS. 5 and 6, an alternative preferred embodiment of the present invention 11 incorporates the same frame and frame attachment system as the previously described embodiment of the present invention 10. This embodiment would be used for unusually deep trenches, unusually wide trenches, or whenever non-standard trenches are needed or where the weight of previously described embodiment of the present invention 10 would be too heavy to handle satisfactorily in the field.

The frame members 46 are attached to the sidewalls 14 using nuts and bolts through holes 70*a*, 70*b*, 70*c* or 70*d* or bolts 74 attached to the frames to create the desired slope of the trench where the forward end 118 will be maintained at a higher elevation than the rearward end 116 to permit the unimpeded flow of the liquid.

The sidewalls 14 comprise a plurality of removably attachable juxtaposed wall members 88 which define the vertical sides of the trench. The sidewalls 14 and bottom sections 77 can be molded, formed, or extruded from a variety of rigid materials, such as stainless steel, galvanized or coated steel, mild steel, aluminum, wood, fiberglass, or a plastic compound.

The method of installing the frame members 46 is identical to the method previously discussed, so as to provide a sloping or neutral trench when completed. Inside and between the sidewalls 14 are a plurality of supporting braces 79 running parallel to the frames 46 with holes to match where the nuts and bolts 74 go through the frame or where (as shown in FIG. 2) bolt 69 attached to the frame 46 is substituted for bolt 74. A plurality of spacer bars 75, or other internal support means, are used to keep the frame members 46 parallel with each other and can be used with frame bolt 74 or bolt 69 (as shown in FIG. 2). A hole 83 in the end of each spacer bar 75 attaches to the supporting braces 79 and the frames 46.

A rigid base section 73 defines the bottom of the trench in this embodiment 11. The rigid base section 73 can comprise a plurality of removably attachable juxtaposed plates 77, which can be flat, curved, or pointed depending upon the job requirements. When two or more pieces form the bottom 77 they may be held together at connecting points 78 by nuts and bolts 82 or other such devices. The sidewalls 14 and the bottom 77 can be joined by using a nut and bolt 76 so that the sidewalls and the bottom meet at the same point 81.

When unit 10 or 11 is formed it may be supported by anchor collars 94 and rods 92 driven into the subsoil (as shown in FIGS. 4 and 6). An alternative method is to support the unit 10 or 11 by holding it in place from the top, above the finished surface, held from studs 80 by a wire (not shown) or similar material, to a device secured to each side of the trench (as shown in FIG. 7).

Figure 7:
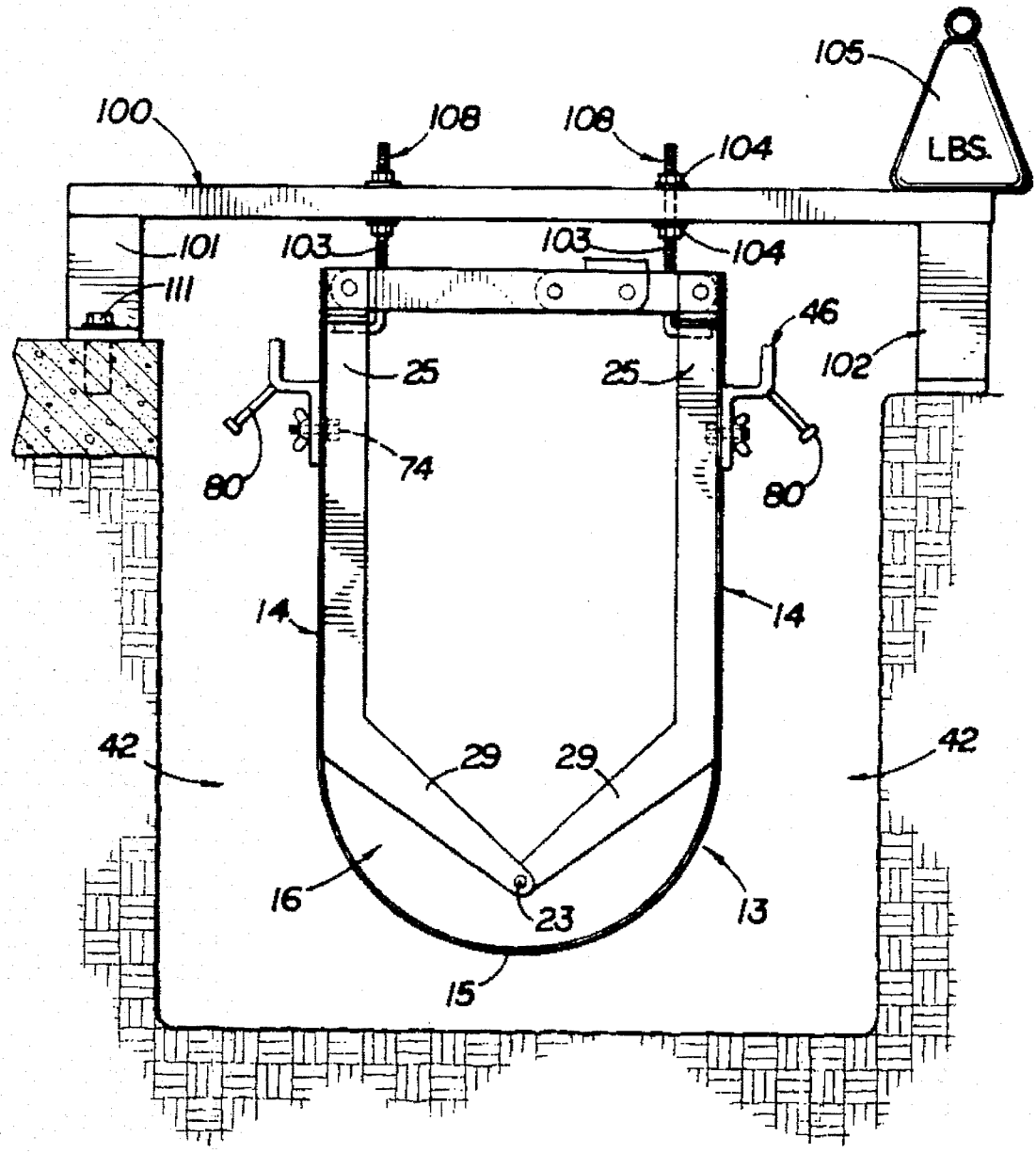
FIG. 7 is a cross-sectional view of a means to hold a collapsible wall assembly leveled and ready to pour.
Figure 4:
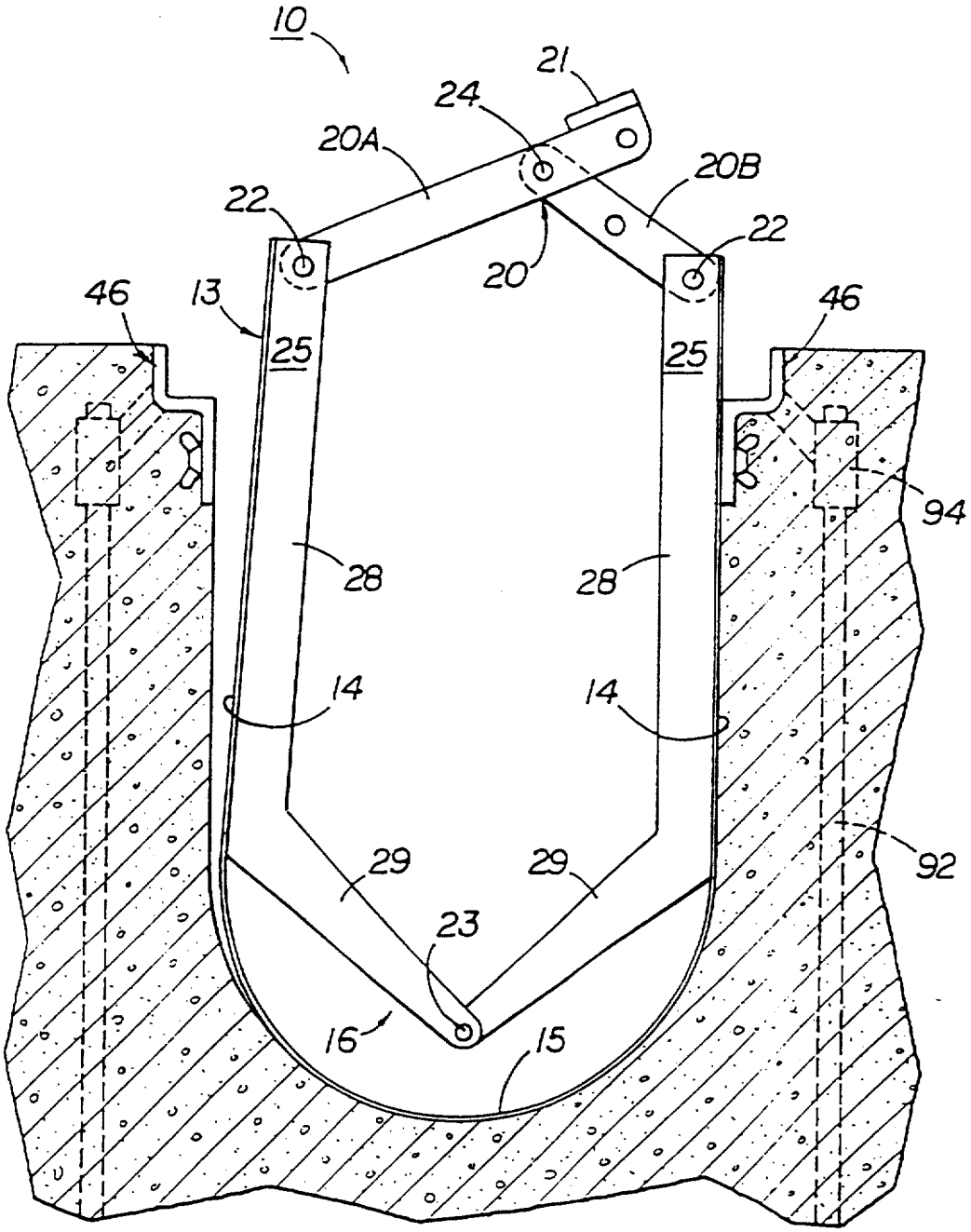

One such method of securing the trench is shown in FIG. 7. This method uses a bolt 103 which holds up the form with a depending threaded portion 108 extending upward with a pair of nuts 104 which position the top of frame 46 to the finished grade height.

It should be noted that all forms will tend to float when surrounded by a viscous material. There are two solutions to this potential problem.

The first is to make the first pour slightly above the trench bottom. As soon as it starts setting, pour both sides of the remaining sidewalls and vibrate the material where the first and second pours occur. No floating will occur since there will be no hydrostatic upward pressure.

The second method requires only a single pour but hanging a form 100 and blocks 101 must be firmly anchored with expansion bolts 111 into the concrete or as with 100 and blocks 102 weighted down by a weight 105 sufficient to prevent floating.

After the concrete or other material has been poured to the proper frame 46 top height and allowed to harden, bolts 74 are removed along with supporting members 79 and spreader bars 75. Bolts 76 and optionally bolts 82 are removed after which the bottom 77 is removed and sidewalls 14 are pushed inward and pulled out, leaving a trench with parallel and level frames, with walls and bottoms reusable.

INSTALLATION AND OPERATION

The installation and operation of the form system embodiments 10 and 11 to form a trench are as follows. A channel 42 is dug in the ground deep enough and wide enough to hold the trench forming system and the concrete or other material surrounding it. Should more than one trench be needed, this channel 42 should be broad enough at each junction to hold a catch basin or junction box. In any embodiment, the next major step is assembling the whole trench system 10 or 11 in the channel 42.

In the preferred embodiment referring to FIGS. 1 and 5, the frames 46 must be attached to the sidewalls 14 so that the depth of the trench and the slope of the trench are as specified. The frame 46 must be held securely to the sidewall in a precise position. To accomplish this a series of holes 26 in sidewalls 14 aligned with holes 70*a*, complete slots 70*b*, partial slots 70*c*, staggered slots 70*d* or bolts 69 attached to the frame or other adjustable means in order to attach a frame with nuts and bolts 74 in a precise position. Each channel attaches to the adjacent channel, if required, being held in position by an internal female collar 85. Frames 46 are aligned sequentially end to end, sloped properly and mounted for the proper trench depth.

Once the trench system 10 or 11 has been assembled in the channel 42, it is coated on the exterior with a releasing agent such as "Crete Lease 10" by Cresset Chemical Co. or similar material. It is then arranged in the channel 42 along its ultimate path, is raised approximately to its finished grade height, and supported at that grade by supporting members 100, 101,102, or 103. As an alternative, a plurality of supporting rods 92 are placed at regular intervals into the ground, one through each collar 94. Once the supporting rods 92 are secure, the trench 10 is adjusted to the finished grade, and is tightly fastened to the supporting rods 92 by bolts 98 through the threaded bores 96 in the collars 94.

When the trench 10 or 11 is completed and in place, a material such as duct tape is placed on the exterior of the form covering any of the open frame holding holes. Concrete or other material is poured around the form, until the level of the concrete reaches the top of each frame 46. Finally, grates or covers are placed on each trench 10. After the concrete or other material has hardened sufficiently the frame bolts 74 in the embodiment 10 shown in FIG. 1, and frame bolts 74, 76 and 82 are removed from the embodiment 11 shown in FIG. 5. In first embodiment 10 as shown in FIG. 4 hinged member 20 is lifted at two or more points at which time the entire reusable form may be removed ready for reuse.

In the embodiment 11, as shown in FIG. 5, the spreader bars 75 are removed. Sidewalls 14 are pushed inward and removed along with bottom 77. All parts are then ready for reuse.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of the invention.

What is claimed is:

1. A trench form for constructing a trench in the ground utilizing a trench-forming material, comprising:

a. two frame members, one on each side of the trench along at least a portion of its length;

b. a plurality of adjustable anchoring means attached to each of the frame members for positioning the frame members relative to the ground and relative to each other;

c. a reusable form pan, positioned within the trench between the frame members, which defines the shape of the interior of the trench and which provides a form around which the trench-forming material is poured and hardened, comprising:

i. two sidewalls for defining the sides of the trench;

ii. a flexible base interconnecting the sidewalls for defining the bottom side of the trench; and iii. a plurality of internal support means on the interior surface of the sidewalls and being movable between an operable position, for supporting and providing rigidity to the sidewalls while the trench-forming material is being poured around the trench form, and an inoperable position whereby the pan can be removed from the trench;

d. means for moving the support means between the operable and inoperable positions; and e. means for adjustably and removably securing the reusable form pan to each frame member.

2. The trench form of claim 1 wherein the means for adjustably securing each frame member to the form pan further comprises:

a. a plurality of vertically arranged openings in the sidewall;

b. at least two openings in the frame member; and c. a fastening means in registration with at least two of the openings in the sidewall and at least two of the openings in the frame member, such that the slope of the trench is determined by selecting the appropriate openings in the sidewall and the frame member corresponding to the desired slope and disposing the fastening means through the selected openings.

3. The trench form of claim 2 wherein at least one of the openings in the frame member is shaped to allow vertical movement of the bolt relative to the frame such that the trench slope is adjusted by selecting the vertical position of the bolt in relation to the frame member.

4. An apparatus for forming a trench, comprising:

a. a form having a pair of upstanding walls, each having upper and opposed lower surfaces, and a bottom interconnecting the lower surfaces of the walls;

b. stiffening members secured along the inner surfaces of the walls in opposed relationship, each stiffening member having a top end and an opposed lower end, the lower ends of a pair of oppositely disposed stiffening members being joined together about a common pivot point;

c. first and second rigid elements, each having first ends and oppositely disposed second ends, the first rigid element being pivotally mounted about its first end to one of the top ends of a pair of oppositely disposed stiffening members and the second rigid element being pivotally mounted about its respective first end to the top end of the other stiffening member of the pair, the rigid elements being hingedly connected together adjacent their second ends between open and closed positions, wherein the rigid elements are co-planar in the closed position;

d. a pair of frame members located external to and on each side of the upstanding walls;

e. means for adjustably securing the frame members to the upstanding walls; and f. adjustable anchoring means attached to the frame members for providing vertical adjustment of the frame members relative to the ground and each other.

5. A trench form for constructing a trench utilizing a trench-forming material, comprising:

a. two frame members, one on each side of the trench, positioned along the length of the trench;

b. a plurality of adjustable anchoring means attached to each of the frame members for positioning the frame members relative to the ground so as to provide vertical adjustment of the frame members relative to the ground and relative to each other, the anchoring means further comprising:

i. a supporting rod capable of being securely anchored to the ground;

ii. a collar having an opening along its length which receives the supporting rod therethrough;

iii. means for securing the collar to the frame member; and iv. means for adjustably securing the collar to a selected position on the rod;

c. a reusable form pan, positioned along the length of the trench, which defines the shape of the interior of the trench and which provides a form around which the trench-forming material is poured and hardened and which further comprises:

i. a flexible base for defining the bottom side of the trench;

ii. two sidewalls for defining the vertical sides of the trench connected to the base; and iii. a plurality of internal support means for supporting the sidewalls while the trench-forming material is being poured around the trench form and for separating the trench form from the trench after the trench-forming material has hardened, comprising: two rigid legs, each with a top end and a bottom end, each providing support to one sidewall; hinge means for hingedly connecting the two rigid legs at the bottom end of the rigid legs; and locking means connecting the top ends of the two rigid legs; and d. means for adjustably and removably securing each frame member to the reusable form pan, comprising:

i. a plurality of vertically arranged holes in the sidewall;

ii. at least one hole in the frame member; and iii. at least one bolt passing through one of the holes in the sidewall and one of the holes in the frame member, such that the slope of the trench is determined by selecting the holes in the sidewall and the frame member.

* * * * *

UNITED STATES PATENT AND TRADEMARK OFFICE

CERTIFICATE OF CORRECTION

PATENT NO. : 5,538,361

DATED : July 23, 1996

INVENTOR(S) : John V. Beamer

It is certified that error appears in the above-indentified patent and that said Letters Patent is hereby corrected as shown below:

IN THE DRAWINGS

Delete Drawing Sheet 4, and substitute therefor the Drawing Sheet, consisting of FIG. 4, as shown on the attached page.

Signed and Sealed this

Fifteenth Day of April, 1997

Bruce Lehman

*Attest:*

BRUCE LEHMAN

*Attesting Officer*

*Commissioner of Patents and Trademarks*